US007354546B2

(12) United States Patent
Kim et al.

(10) Patent No.: US 7,354,546 B2
(45) Date of Patent: Apr. 8, 2008

(54) PROCESS OF PREPARING CONTINUOUS FILAMENT COMPOSED OF NANO FIBER

(75) Inventors: Hag-Yong Kim, 410-6, Pyunghwa-dong 2 ga, Wansan-gu, Jeonju-si, Jeollabuk-do, 560-865 (KR); Myung-Seop Gil, Jeollabuk-do (KR); Yoon-Ho Jung, Jeollabuk-do (KR); Hyung-Jun Kim, Jeollabuk-do (KR); Bong-Seok Lee, Jeollabuk-do (KR)

(73) Assignees: Hag-Yong Kim, Jeonju-si (KR); Jong Cheol Park, Seoul (KR)

( * ) Notice: Subject to any disclaimer, the term of this patent is extended or adjusted under 35 U.S.C. 154(b) by 53 days.

(21) Appl. No.: 10/512,095

(22) PCT Filed: Jul. 23, 2003

(86) PCT No.: PCT/KR03/01460

§ 371 (c)(1),
(2), (4) Date: Oct. 21, 2004

(87) PCT Pub. No.: WO2004/074559

PCT Pub. Date: Sep. 2, 2004

(65) Prior Publication Data

US 2005/0253305 A1 Nov. 17, 2005

(30) Foreign Application Priority Data

Feb. 24, 2003 (KR) ..... 10-2003-0011296

(51) Int. Cl.
*D01D 5/00* (2006.01)

(52) U.S. Cl. ..... 264/465; 977/904; 977/840

(58) Field of Classification Search ..... 264/465; 977/904, 840

See application file for complete search history.

(56) References Cited

U.S. PATENT DOCUMENTS

| | | | | |
|---|---|---|---|---|
| 2,746,839 | A * | 5/1956 | Terry et al. | 264/167 |
| 6,520,425 | B1 * | 2/2003 | Reneker | 239/294 |
| 2002/0100725 | A1 * | 8/2002 | Lee et al. | 210/503 |
| 2002/0175449 | A1 | 11/2002 | Setauket et al. | |

FOREIGN PATENT DOCUMENTS

| | | | |
|---|---|---|---|
| JP | 1991-161502 | A | 7/1991 |
| KR | 2002-0051066 | A | 6/2002 |
| KR | 2003-0003925 | A | 1/2003 |

OTHER PUBLICATIONS

Seeram Ramakrishna et al., An Introduction to Electrospinning and Nanofibers, 2005, World Scientific Publishing Co. Pte. Ltd., pp. 147-148.*

Myung-Seob Khil et al., Novel Fabricated Matrix Via Electrospinning for Tissue Engineering, Journal of Biomedical Materials Research Part B: Applied Biomaterials, Aug. 27, 2004, Wiley Periodicals, Inc., vol. 72B, Issue 1, pp. 117-124.*

* cited by examiner

*Primary Examiner*—Christina Johnson
*Assistant Examiner*—Patrick Butler
(74) *Attorney, Agent, or Firm*—Birch, Stewart, Kolasch & Birch, LLP

(57) ABSTRACT

The present invention relates to a process of preparing a continuous filament composed of a nano fiber, wherein nano fibers are prepared by spinning a polymer spinning dope in a spinning dope main tank (20) onto the surface of water or organic solvent (4*a*) of a collector (4), which contains water or inorganic solvent (4*a*) and has a conductive material (5) with a high voltage applied sunken in the water or organic solvent (4*a*), through nozzles (2) with a high voltage applied, and the nano fibers are pressed, drawn, dried and wound while being pulled by a rotary roller (6) rotating at a constant linear velocity from the location spaced more than 1 cm from one end of a dropping spot. The present invention can prepare a continuous filament composed of a nano fiber by an electrospinning method and a continuous process.

10 Claims, 3 Drawing Sheets

PROCESS OF PREPARING CONTINUOUS FILAMENT COMPOSED OF NANO FIBER

TECHNICAL FIELD

The present invention relates to a process of preparing a continuous filament or yarn (hereinafter, commonly referred to as a "filament") composed of nano fibers, and more particularly, to a process of preparing a continuous filament composed of nano fibers, using an electrospinning method.

In the present invention, the nano fiber defines a fiber having a fiber diameter of less than 1,000 nm, more preferably, less than 500 nm.

A woven fabric composed of nano fibers can be utilized for making artificial leather, filters, diapers, sanitary pads, sutures, antisetting agents, wiping cloth, artificial vessels, bone fixing devices and the like, and is particularly useful for the production of the artificial leather.

BACKGROUND ART

As conventional techniques for preparing an ultra fine fiber or nano fiber suitable for the production of an artificial leather, there are known a sea-island type conjugated spinning method, a split type conjugated spinning method, a blend spinning method and the like However, in case of the sea-island type conjugated spinning method or the blend spinning method, one of two polymer components consisting of a fiber must be dissolved and removed to make the ultra fine fiber. In order to produce artificial leather from fiber prepared by these methods, a complex process must be carried out, including melt spinning, fiber production, non-woven fabric production, urethane impregnation and single component dissolution.

Nevertheless, it is impossible to produce a fiber with a diameter of less than 1,000 nm by the above two methods.

In case of the spit type conjugate spinning method, it is problematic in that since two polymer components (for example, a polyester and a polyamide) with different dyeing properties co-exist in the fiber, uneven dyeing is exhibited and the artificial leather production process is complicated. In addition, it is difficult to produce a fiber with a diameter less than 2,000 nm by the above method.

Another conventional technique for preparing nano fibers is the electrospinning method. In the electrospinning method, as shown in FIG. 4, a polymer spinning dope in a spinning dope main tank (20) is continuously and constantly fed to a plurality of nozzles (2), to which a high voltage is applied, through a metering pump (21). Subsequently, the spinning dope fed to the nozzles (2) is spun and collected through the nozzles (2) on a collector (4) of an endless belt type having a high voltage of more than 5 kV, thereby producing a fiber web. The fiber web produced is needle-punched in the next process to produce a non-woven fabric composed of nano fibers.

As seen from above, the conventional electrospinning method can produce only a web or non-woven fabric composed of a nano fiber less than 1,000 nm. Hence, to prepare a continuous filament by the conventional electrospinning method, the produced nano fiber web has to be cut to a predetermined length to produce a staple and this staple has to undergo an additional spinning process to produce spun yarn, which makes the process complicated.

In case of the non-woven fabric composed of nano fiber, there is a limitation to employing the non-woven fabric to various fields of application, such as the artificial leather, due to the limits in the physical properties of the non-woven fabric. For reference, it is difficult to achieve physical properties of more than 10 MPa from non-woven fabric composed of nano fiber.

The present invention is intended to prepare a continuous filament composed of nano fiber utilizing a simple procedure of providing a process of continuously preparing a filament (yarn) using electrically spun nano fiber web, without any additional spinning process. Additionally, the present invention is intended to provide a continuous filament of nano fiber which is superior in physical properties and is suitable for various industrial materials, such as filters, diapers, sanitary pads, artificial vessels and so on, as well as artificial leather.

DISCLOSURE OF INVENTION

The present invention has been developed for the purpose of solving the foregoing problems and thus it is an object of the present invention to provide a process of preparing a continuous filament composed of nano fiber, wherein nano fibers are prepared by spinning a polymer spinning dope in a spinning dope main tank (20) onto the surface of water or an organic solvent (4*a*) disposed in a collector (4), providing a conductive material (5) with a high voltage applied sunken in the water or organic solvent (4*a*), through nozzles (2) with a high voltage applied, and the nano fibers are pressed, drawn, dried and wound while being pulled by a rotary roller (6) rotating at a constant linear velocity from the location spaced more than 1 cm from one end of a dropping spot.

BRIEF DESCRIPTION OF THE DRAWINGS

The present invention will be described in detail with reference to the accompanying drawings, now wherein.

DETAILED DESCRIPTION OF THE INVENTION

Figure 1:
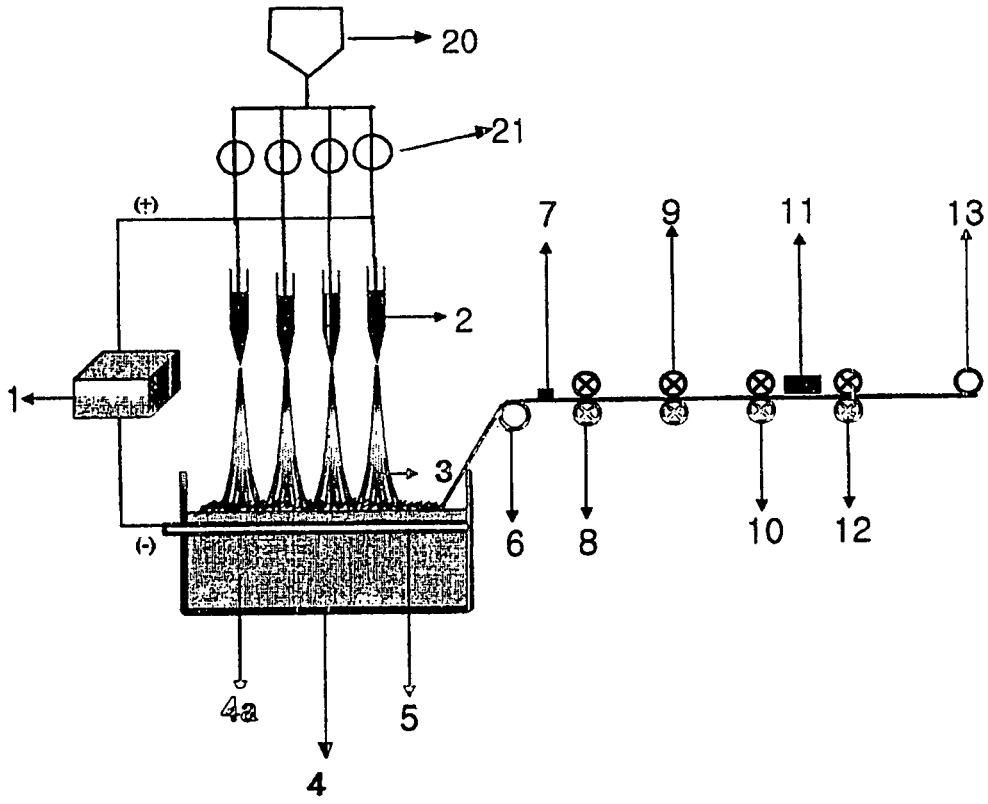
FIG. 1 is a schematic view showing the process of the present invention.

In the present invention, as shown in FIG. 1, a polymer spinning dope disposed in a spinning dope main tank (20) is continuously fed to a plurality of nozzles (2) through a metering pump (21). The nozzles (2) have a high voltage of more than 5 kV applied therefor by a voltage generator (1).

Next, the constantly fed polymer spinning dope fed through the plurality of nozzles (2) is electrically spun into spun nano fibers 3 onto the surface of water or an organic solvent (4*a*) in a collector (4) specifically provided to collect nano fiber.

The collector (4) is a container containing water or organic solvent (4*a*) and has a construction whereby a conductive material (5) having a high voltage of more than 5 kV applied thereto by the voltage generator (1) is submerged in the water or organic solvent (4*a*) disposed in the container.

The conductive material (5) is a metal plate or metal powder. The distance (h) from the surface of the water or organic solvent (4*a*) contained in the collector (4) to the top surface of the conductive material (5) is 0.01 to 200 mm, more preferably, 5 to 50 mm.

If the distance (h) is too small, the spun nano fiber is placed in direct contact with the surface of the conductive material (5) and thereafter cannot be pulled away well by a rotary roller (6), thereby making the process difficult. If the distance (h) is too large, the voltage applied to the conductive material (5) is not transferred well to the surface of water or organic solvent, thereby making the collected state of the nano fiber very poor.

The diameter of the spun nano fiber is less than 1,000 nm, more preferably, less than 500 nm.

Next, the nano fibers, spun and collected on the surface of the water or organic solvent (4*a*) contained in the collector (4) are continuously pulled by the rotary roller (6) to thus form an undrawn filament (an aggregate of nano fibers).

The angle (θ) between the nano fibers spun and collected on the surface of water or organic solvent (4*a*) in the collector (4) and the undrawn filament (aggregate of nano fibers) pulled by the rotary roller (6) is 0 to 180° C., more preferably, 10 to 90° C.

The distance (d) from one end of the dropping spot of the nano fibers, to the initial point where the nano fibers are pulled by the rotary roller (6) is more than 1 cm. If the distance (d) is less than 1 cm, the spun nano fibers are pulled up in a state where they have not sufficiently coagulated, thereby making the production of a continuous filament more difficult.

Next, the undrawn filament (aggregate of nano fibers) pulled by the rotary roller (6) to tension controlled 7 is pressed by press rollers (8), (9), (10) and (12) to remove the residual water or organic solvent in the aggregate, then dried by drier (11) after being drawn between drawing rollers (8, 10 and 12) and then are wound by a winding roller (13). The drawn filament may be twisted by a twister before it is wound.

In the present invention, an electric spinning process, a process of pulling nano fibers, a pressing process, a drawing process and a drying process are continuously carried out.

The polymer spinning dope of the present invention is composed of a polyester resin, nylon resin, a polysulfon resin, a polylactic acid, a copolymer thereof or a mixture thereof.

Figure 3:
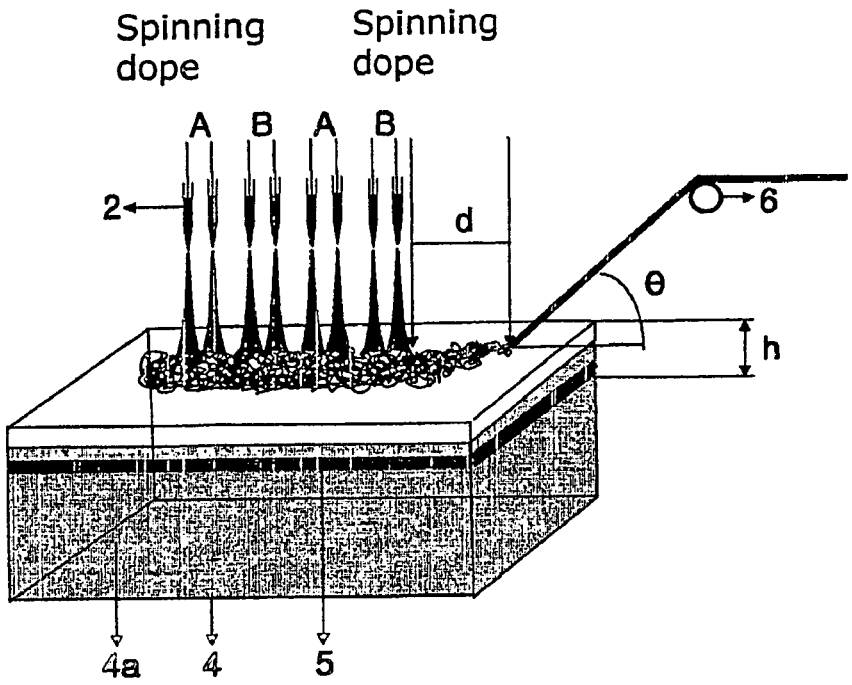
FIG. 3 is a schematic view showing a process of spinning two kinds of polymer spinning dopes onto one collector.

As shown in FIG. 3, the present invention also includes a method of preparing a filament composed of a hybrid nano fiber by spinning more than two kinds of polymer spinning dope to the surface of water or organic solvent (4*a*) contained in the same collector (4) through each of the nozzles (2).

Additionally, the present invention also includes a method of preparing a filament composed of hybrid nano fibers by spinning two kinds of polymer spinning dope with respective nozzles (2) and a respective collector (4) and then blending the two kinds of spun nano fibers by pulling them with the same rotary roller (6).

Additionally, the present invention also includes a method of preparing a filament composed of hybrid nano fibers by twisting two kinds of filaments separately spun, drawn and wound according to the method of the present invention.

Figure 2:
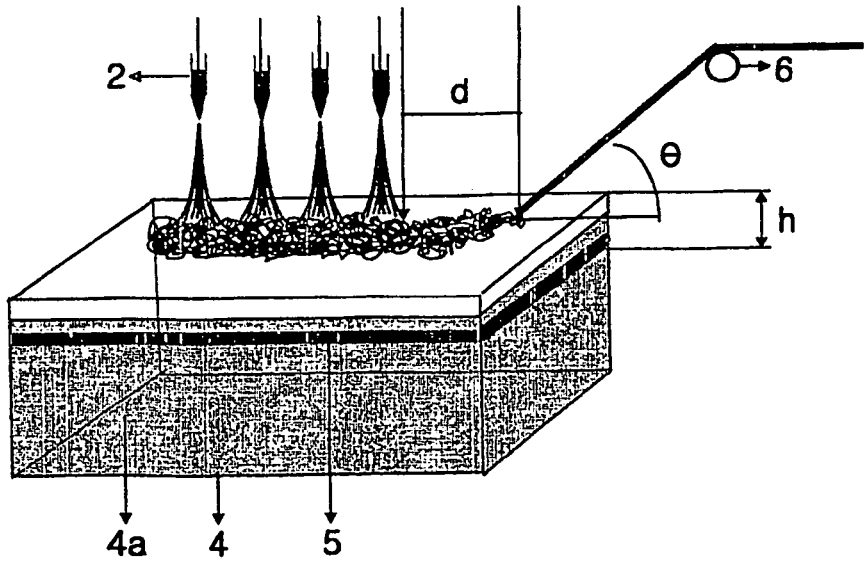
FIG. 2 is an enlarged view of a collector used in the present invention.
Figure 4:
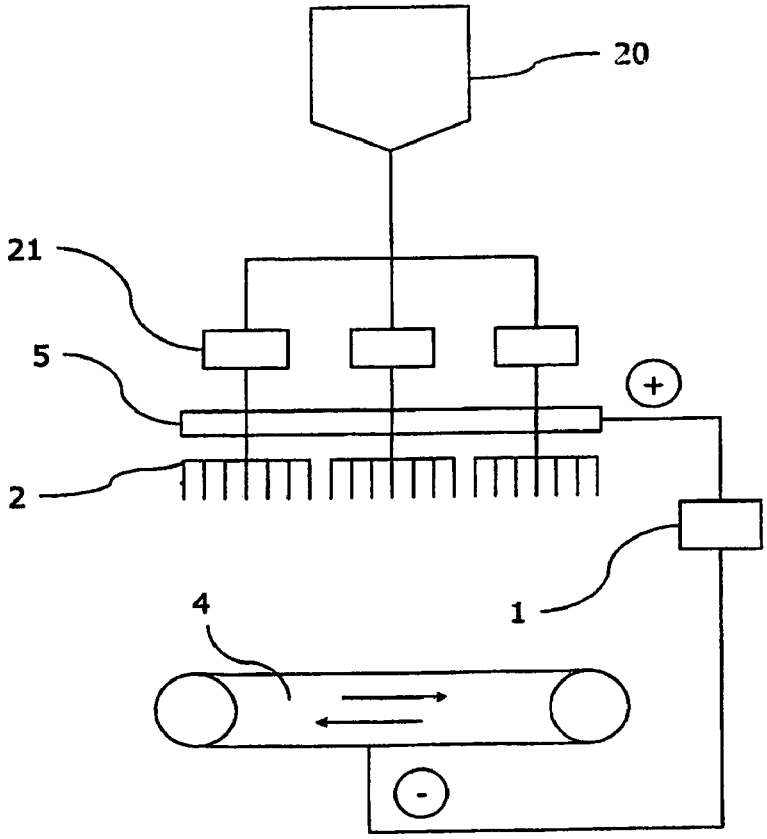
FIG. 4 is a schematic view showing a process of a conventional electrospinning method for preparing a nano fiber web.
Figure 5:
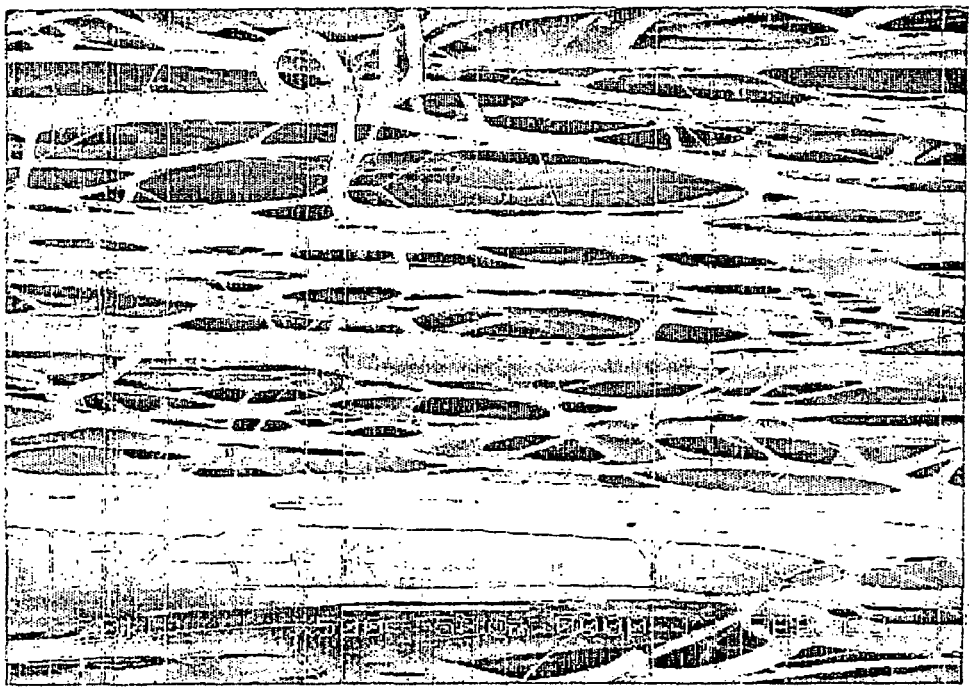
FIG. 5 is a scanning electron micrograph of a surface of an undrawn filament (aggregate of nano fibers) prepared according to Example 1.
Figure 6:
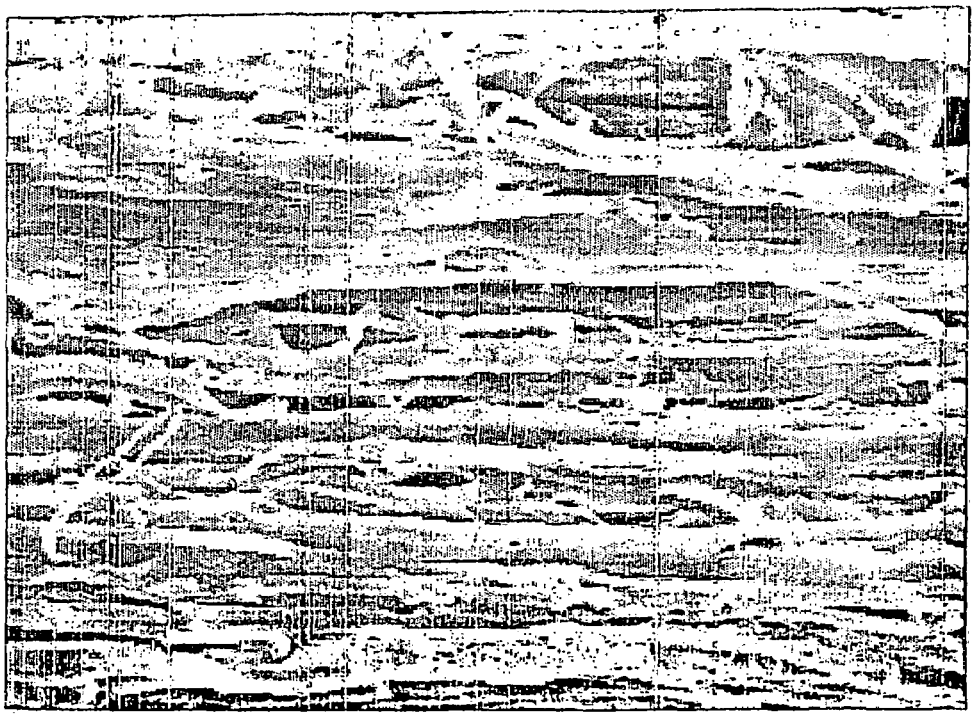
FIG. 6 is a scanning electron micrograph of a surface of an undrawn filament (aggregate of nano fibers) prepared according to Example 5.

FIG. 1 is a schematic view showing the process of the present invention;

FIG. 2 is an enlarged view of a collector used in the present invention;

FIG. 3 is a schematic view showing a process of spinning two kinds of polymer spinning dopes onto one collector;

FIG. 4 is a schematic view showing a process of a conventional electrospinning method for preparing a nano fiber web;

FIG. 5 is a scanning electron micrograph of a surface of an undrawn filament (aggregate of nano fibers) prepared according to Example 1; and FIG. 6 is a scanning electron micrograph of a surface of an undrawn filament (aggregate of nano fibers) prepared according to Example 5.

BEST MODES FOR CARRYING OUT THE INVENTION

Hereinafter, the present invention will be described in detail with reference to examples. But, this invention is not limited to the following examples.

Example 1

A polymer spinning dope was prepared by dissolving a poly(ε-caprolactone) polymer (purchased from Aldrich Chemical Company) having a number average molecular weight of 80,000 in a mixed solvent of methylene chloride/N, N'-dimethyl form amide (volume ratio: 75/25) at a concentration of 13% by weight. The polymer spinning dope had a surface tension of 35 mN/m, a solution viscosity of 35 centipoise at an ambient temperature, an electric conductivity of 0.02 mS/m and a permittivity constant of 90. The polymer spinning dope was constantly fed to 15 nozzles (2) with a 1 mm diameter and a 25 kV voltage applied through a metering pump (21). Then, as shown in FIG. 1, the polymer spinning dope was electrically spun onto a collector (4) of this invention, which contains water (4*a*) and has a conductive material (5) of a copper plate with a 25 kV voltage and a 10 mm thickness sunken in the water (4*a*), more concretely, onto the surface of water contained in the collector (4). The distance (h) from the surface of water to the top surface of the conductive material (5) was 1 cm. Continually, nano fibers spun and agglomerated on the surface of water contained in the container (4) were pulled by a rotary roller (6) with a linear velocity of 36 m/min to thus prepare an undrawn filament (aggregate of nano fibers). The angle (.theta.) between the nano fibers located on the water surface and the undrawn filament (aggregate of nano fibers) pulled by the rotary roller (6) was 30°. The distance (d) from one end of a dropping spot of the nano fibers to the initial point where the nano fibers are pulled by the rotary roller (6) was 5 cm. The thusly prepared undrawn filament (aggregate of nano fibers) had a fineness of 108 deniers, a strength of 0.22 g/d and an elongation of 106%, and an electron micrograph of the surface thereof is as shown in FIG. 5. Continually, the undrawn filament (aggregate of nano fibers) having passed through the rotary roller was pressed by a press roller (9), dried by a drier (11) while being drawn by drawing rollers (8, 10 and 12) so that the total draw ratio becomes 1.4 and then wound by a winding roller (13), thereby preparing a continuous filament composed of a nano fiber. The finally prepared continuous filament (composed of a nano fiber and drawn) had a strength of 1.4 g/d and an elongation of 35%.

Example 2

A polymer spinning dope was prepared by dissolving a nylon-6 resin, which has a relative viscosity of 3.2 in a 96% sulfuric acid solution, in a form acid at a concentration of 15% by weight. The polymer spinning dope had a surface tension of 49 mN/m, a solution viscosity of 40 centipoise at an ambient temperature and an electric conductivity of 420 mS/m. The polymer spinning dope was constantly fed to 15 nozzles (2) with a 1 mm diameter and a 30 kV voltage applied through a metering pump (21). Then, as shown in FIG. 1, the polymer spinning dope was electrically spun onto a collector (4) of this invention, which contains water (4*a*) and having a conductive material (5) of a copper plate with a 30 kV voltage and a 20 mm thickness sunken in the water (4*a*), more concretely, onto the surface of water contained in the collector (4). The distance (h) from the surface of water to the top surface of the conductive material (5) was 1 cm. Continually, nano fibers spun and agglomerated on the surface of water were pulled by a rotary roller (6) with a linear velocity of 30 m/min to thus prepare an undrawn filament (aggregate of nano fibers). The angle (θ) between the nano fibers located on the water surface and the undrawn filament (aggregate of nano fibers) pulled by the rotary roller (6) was 40°. The distance (d) from one end of a dropping spot of the nano fibers to the initial point where the nano fibers are pulled by the rotary roller (6) was 8 cm. The prepared undrawn filament (aggregate of nano fibers) had a fineness of 110 deniers, a strength of 0.56 g/d and an elongation of 205%. Continually, the undrawn filament (aggregate of nano fibers) having passed through the rotary roller was pressed by a press roller (9), dried by a drier (11) while being drawn by drawing rollers (8, 10 and 12) so that the total draw ratio becomes 2.8 and then wound by a winding roller (13), thereby preparing a continuous filament composed of a nano fiber. The finally prepared continuous filament (composed of a nano fiber and drawn) had a strength of 2.8 g/d and an elongation of 35%.

Example 3

A polyester spinning dope (hereinafter, referred to as a spinning dope B) was prepared by dissolving a polyester resin with an intrinsic viscosity of 0.64 in a mixed solvent of trifluoro acetic acid/methylene chloride (volume ratio: 50/50) at a concentration of 15% by weight. The nylon-6 spinning dope (hereinafter, referred to as a "spinning dope A") of Example 2 and the spinning dope B were constantly fed to 15 nozzles (2) with a 1 mm diameter and a 25 kV voltage applied alternately through a metering pump (21). Then, as shown in FIG. 1, the spinning dope A and the spinning dope B were electrically spun onto a collector (4) of this invention, which contains water (4*a*) and has a conductive material (5) of a copper plate with a 25 kV voltage and a 10 mm thickness sunken in the water (4*a*), more concretely, onto the surface of water contained in the collector (4). The distance (h) from the surface of water to the top surface of the conductive material (5) was 1 cm. Continually, nano fibers spun and agglomerated on the surface of water were pulled by a rotary roller (6) with a linear velocity of 20 m/min to thus prepare a hybrid undrawn filament (aggregate of nano fibers). The angle (θ) between the nano fibers located on the water surface and the hybrid undrawn filament (aggregate of nano fibers) pulled by the rotary roller (6) was 30°. The distance (d) from one end of a dropping spot of the nano fibers to the initial point where the nano fibers are pulled by the rotary roller (6) was 5 cm. Continually, the undrawn filament (aggregate of nano fibers) having passed through the rotary roller was pressed by a press roller (9), dried by a drier (11) while being drawn by drawing rollers (8, 10 and 12) so that the total draw ratio becomes 3.0 and then wound by a winding roller (13), thereby preparing a continuous filament composed of a hybrid nano fiber. The finally prepared continuous filament (composed of a nano fiber and drawn) had a strength of 2.7 g/d and an elongation of 46%.

Example 4

A polymer spinning dope was prepared by dissolving a polyvinyl alcohol (purchased from Celanese) having a number average molecular weight of 65,000 and a viscosity of 96% in a 80° C. distilled water at a concentration of 10% by weight and adding phosphoric acid therein so that the polyvinyl alcohol has a pH 2.5. The polymer spinning dope was constantly fed to 15 nozzles (2) with a 1 mm diameter and a 20 kV voltage applied through a metering pump (21). Then, as shown in FIG. 1, the polymer spinning dope was electrically spun onto a collector (4) of this invention, which contains ethanol (4*a*) and having a conductive material (5) of a copper plate with a 20 kV voltage and a 20 mm thickness sunken in the ethanol (4*a*), more concretely, onto the surface of ethanol contained in the collector (4). The distance (h) from the surface of ethanol to the top surface of the conductive material (5) was 1 cm. Continually, nano fibers spun and agglomerated on the surface of ethanol were pulled by a rotary roller (6) with a linear velocity of 30 m/min to thus prepare an undrawn filament (aggregate of nano fibers). The angle (θ) between the nano fibers located on the ethanol surface and the undrawn filament (aggregate of nano fibers) pulled by the rotary roller (6) was 30°. The distance (d) from one end of a dropping spot of the nano fibers to the initial point where the nano fibers are pulled by the rotary roller (6) was 10 cm. Continually, the undrawn filament (aggregate of nano fibers) having passed through the rotary roller was pressed by a press roller (9), dried by a drier (11) while being drawn by drawing rollers (8, 10 and 12) so that the total draw ratio becomes 2.0 and then wound by a winding roller (13), thereby preparing a continuous filament composed of a nano fiber. The finally prepared continuous filament (composed of a nano fiber and drawn) had a strength of 1.5 g/d and an elongation of 45%. The average diameter of the nano fiber was 250 nm.

Example 5

A polymer spinning dope was prepared by dissolving a polyurethane resin having a molecular weight of 80,000 in a mixed solvent of dimethyl formamide/tetrahydrofuran (volume ratio: 5/5) at a concentration of 13.5% by weight. The polymer spinning dope was constantly fed to 15 nozzles (2) with a 1 mm diameter and a 30 kV voltage applied through a metering pump (21). Then, as shown in FIG. 1, the polymer spinning dope was electrically spun onto a collector (4) of this invention, which contains water (4*a*) and having a conductive material (5) of a copper plate with a 30 kV voltage and a 10 mm thickness sunken in the water (4*a*), more concretely, onto the surface of water contained in the collector (4). The distance (h) from the surface of water to the top surface of the conductive material (5) was 1.5 cm. Continually, nano fibers spun and agglomerated on the surface of water were pulled by a rotary roller (6) with a linear velocity of 36 m/min to thus prepare an undrawn filament (aggregate of nano fibers). The angle (θ) between the nano fibers located on the water surface and the undrawn filament (aggregate of nano fibers) pulled by the rotary roller (6) was 30°. The distance (d) from one end of a dropping spot of the nano fibers to the initial point where the nano fibers are pulled by the rotary roller (6) was 10 cm. The thusly prepared undrawn filament (aggregate of nano fibers) had a fineness of 63.5 deniers, a strength of 0.5 g/d and an elongation of 106%, and an electron micrograph of the surface thereof is as shown in FIG. 6. Continually, the undrawn filament (aggregate of nano fibers) having passed through the rotary roller was pressed by a press roller (9), dried by a drier (11) while being drawn by drawing rollers (8, 10 and 12) so that the total draw ratio becomes 1.4 and then wound by a winding roller (13), thereby preparing a continuous filament composed of a nano fiber. The finally prepared continuous filament (composed of a nano fiber and drawn) had a strength of 1.2 g/d and an elongation of 80%.

INDUSTRIAL APPLICABILITY

The present invention produces a continuous filament composed of a nano fibers by a simpler, continuous procedure. The continuous filament prepared according to the present invention is greatly improved in physical properties and thus is useful in various industrial fields, such as an artificial dialyzing filter, artificial vessel, anti-adhesion agent, artificial bone and so on, as well as daily necessaries, such as artificial leather, air cleaning filters, wiping cloth, golf glove, wig and so on.

The invention claimed is:

1. A process of preparing a continuous filament composed of nano fibers, which comprises spinning a polymer spinning dope through nozzles onto a collector surface of water or an organic solvent and which has a conductive material disposed below the collector surface of said water or organic solvent, applying a high voltage to said nozzles and said conductive material, and the nano fibers spun onto the surface of said water or organic solvent are pressed, drawn, dried and wound while being pulled by a rotary roller rotating at a constant linear velocity at a location spaced more than 1 cm from one end of a dropping spot where the spun polymer contacts the collector surface.

2. The process of claim 1, wherein the conductive material is a metal plate or a metal powder.

3. The process of claim 1, wherein the distance from the surface of the water or organic solvent to the top surface of the conductive material is 0.01 to 200 mm.

4. The process of claim 1, wherein the distance from the surface of the water or organic solvent to the top surface of the conductive material is 5 to 50 mm.

5. The process of claim 1, wherein the angel (θ) between the nano fibers collected on the surface of the water or organic solvent and the undrawn filament (aggregate of nano fibers) pulled by a rotary roller is 0 to 180°.

6. The process of claim 1, wherein the angle (θ) between the nano fibers collected on the surface of the water or organic solvent and the undrawn filament (aggregated of nano fibers) pulled by a rotary is 10 to 90°.

7. The process of claim 1, wherein the drawn filament (yarn) is twisted before being wound.

8. The process of claim 1, wherein the diameter of the nano fibers is less than 1,000 nm.

9. The process of claim 1, wherein the polymer spinning dope is selected from the group consisting of polyester resins, nylon resins, polysulfon resins, poly lactic acid and a copolymer thereof or a mixture thereof.

10. The process of claim 1, wherein more than two kinds of polymer spinning dope are spun onto the surface of the water or organic solvent to form two kinds of nano fibers, said two kinds of nano fibers being combined together.

* * * * *